US010816182B1

(12) United States Patent
Chen et al.

(10) Patent No.: US 10,816,182 B1
(45) Date of Patent: Oct. 27, 2020

(54) LED ILLUMINATION APPARATUS MODULE AND LED ILLUMINATION APPARATUS APPLYING THE SAME

(71) Applicant: LUCKYTOWN HOME PRODUCT INC., Taipei (TW)

(72) Inventors: Tsung-Hsien Chen, Taipei (TW); Ming-Dar Lin, Taipei (TW)

(73) Assignee: LUCKYTOWN HOME PRODUCT INC., Taipei (TW)

( * ) Notice: Subject to any disclaimer, the term of this patent is extended or adjusted under 35 U.S.C. 154(b) by 0 days.

(21) Appl. No.: 16/704,532

(22) Filed: Dec. 5, 2019

(30) Foreign Application Priority Data

Sep. 27, 2019 (TW) ..... 108212906 U

(51) Int. Cl.

| | |
|---|---|
| ***F21V 23/04*** | (2006.01) |
| ***F21V 19/00*** | (2006.01) |
| ***F21V 17/06*** | (2006.01) |
| ***F21V 23/00*** | (2015.01) |
| ***F21V 21/32*** | (2006.01) |
| *F21Y 115/10* | (2016.01) |

(52) U.S. Cl.
CPC ..... *F21V 23/04* (2013.01); *F21V 17/06* (2013.01); *F21V 19/003* (2013.01); *F21V 21/32* (2013.01); *F21V 23/001* (2013.01); *F21Y 2115/10* (2016.08)

(58) Field of Classification Search
CPC ..... F21V 23/04; F21V 17/06; F21V 19/003; F21V 21/32; F21V 23/001; F21V 19/001; F21V 21/06; F21V 23/00; F21V 23/003; F21V 23/004; F21V 23/006; F21V 17/00; F21V 17/10; F21V 19/00; F21V 21/00; F21V 1/00; F21V 1/02; F21V 7/00; F21V 7/0066; F21V 7/0075; F21Y 2115/10
See application file for complete search history.

(56) References Cited

U.S. PATENT DOCUMENTS

| | | | | |
|---|---|---|---|---|
| 9,964,840 | B1 * | 5/2018 | Gao | G02B 6/0096 |
| 2010/0053950 | A1 * | 3/2010 | Higuchi | F21V 29/75 362/234 |

* cited by examiner

*Primary Examiner* — Bao Q Truong
(74) *Attorney, Agent, or Firm* — Birch, Stewart, Kolasch & Birch, LLP

(57) ABSTRACT

An LED illumination apparatus module includes a light-emitting component and a mounting base. The light-emitting component includes a load board, a wire, a circuit board, and one or more light-emitting diodes. The light-emitting diode is disposed on the load board, and the wire electrically connects the light-emitting diode and the circuit board. The mounting base includes an LED assembly portion and a frame. The LED assembly portion includes a mounting surface and the load board is fixed on the mounting surface. An end of the frame is connected to the mounting surface of the LED assembly portion. The frame includes a body portion and a circuit board fixing structure. The circuit board fixing structure is disposed on the body portion, and the circuit board is fixed to the circuit board fixing structure. The light-emitting components are mounted on the base in a modularized manner.

20 Claims, 9 Drawing Sheets

LED ILLUMINATION APPARATUS MODULE AND LED ILLUMINATION APPARATUS APPLYING THE SAME

CROSS-REFERENCE TO RELATED APPLICATION

This non-provisional application claims priority under 35 U.S.C. § 119(a) to Patent Application No. 108212906 filed in Taiwan, R.O.C. on Sep. 27, 2019, the entire contents of which are hereby incorporated by reference.

BACKGROUND

Technical Field

The instant disclosure relates to an LED illumination apparatus module and an LED illumination apparatus applying the same, and in particular, to an LED illumination apparatus module that is easy assemble and an LED illumination apparatus using the same.

Related Art

During assembly of an illumination apparatus known to the inventor that can be disposed on a desktop or clamped on a side of a desk, an LED light, a circuit board, a switch, and the like usually have to be fixedly assembled one by one. Moreover, when the switch is assembled to the bottom of a lamp shade, alignment is needed; and when the light-emitting diode component is assembled to an opening of the lamp shade, alignment is also needed. Therefore, the illumination apparatus cannot be assembled effectively. In addition, limited by the size and shape of the lamp shade, an electronic component, such as an electric wire or a circuit board, is easily damaged due to a drag during the assembly. Therefore, how to modularize the illumination apparatus to increase assembly convenience and improve assembly efficiency is an urgent issue that needs to be improved by the inventor of the instant disclosure and a person in the technical field of related industries.

SUMMARY

Therefore, an LED illumination apparatus module that is easy to assemble and an LED illumination apparatus applying the same are provided. In a first embodiment, an LED illumination apparatus module includes a light-emitting component and a mounting base. The light-emitting component includes a load board, a wire, a circuit board, and at least one light-emitting diode, where the light-emitting diode is disposed on a surface of the load board, and the wire is electrically connected to the at least one light-emitting diode and the circuit board. The mounting base includes an LED assembly portion and a frame. The LED assembly portion includes a reflecting surface, a mounting surface, and an opening, where the reflecting surface and the mounting surface are located on two opposite sides. The opening is defined through the reflecting surface and the mounting surface, and the load board is fixed on the mounting surface and corresponds to the opening, so that the at least one light-emitting diode passes through the opening and faces towards the reflecting surface. One end of the frame is connected to the mounting surface of the LED assembly portion. The frame includes a body portion and a circuit board fixing structure, where the circuit board fixing structure is disposed on the body portion, and the circuit board is fixed to the circuit board fixing structure. In this way, a plurality of light-emitting diodes, wires, and circuit boards may be modularized, fixed on the mounting base, and then assembled to the lamp shade together, to enhance assembly convenience and improve the speed of assembly. Since the light-emitting diode, the wire, and the circuit board are fixed on the mounting base, these components can be prevented from being dragged or collided easily during assembling these components to the lamp shade, thereby increasing the assembly yield of LED illumination apparatuses.

In some embodiments, in addition to the body portion and the circuit board fixing structure, the frame further includes a switch fixing structure. The light-emitting component further includes a switch. The switch fixing structure is disposed at an end of the body portion which is away from the LED assembly portion, and the switch is assembled to the switch fixing structure. The switch fixing structure includes a load slot, where the shape of the load slot corresponds to the shape of the switch, so that the switch is closely fitted in the load slot. In this way, the switch fixing structure may be also assembled to the mounting base, and assembled to the lamp shade together with the light-emitting diodes, the wire, and the circuit board, so that assembly steps may be simplified.

In some embodiments, the circuit board fixing structure is located between the switch fixing structure and the LED assembly portion. The circuit board fixing structure includes an upper support and a lower support disposed parallel to each other, and two ends of the circuit board are fixed to the upper support and the lower support, respectively. By using the upper support and the lower support to support different parts of the circuit board and the electronic components disposed on the circuit board, the support force of the circuit board fixing structure can be increased. In addition, by using the upper support and the lower support to assemble with the circuit board, an overall size of the mounting base may be greatly reduced, to make the mounting base lighter and to reduce the material used in the mounting base.

In some embodiments, the upper support is a first protrusion portion, and the lower support is a second protrusion portion. The first protrusion portion and the second protrusion portion extend towards the same direction. The circuit board includes two assembly holes provided in two end portions, respectively. When the circuit board is assembled to the circuit board fixing structure, the first protrusion portion and the second protrusion portion pass through the corresponding assembly holes, respectively.

In some embodiments, the upper support is a first protrusion portion, and the lower support is a second containing slot. A notch of the second containing slot is provided towards the first protrusion portion. The circuit board includes an assembly hole provided in one of two end portions of the circuit board. When the circuit board is assembled to the circuit board fixing structure, the other end portion of the circuit board is disposed in the second containing slot, and the first protrusion portion of the upper support pass through the assembly hole.

In some embodiments, the LED assembly portion further includes two clamping parts disposed on the mounting surface, and the two clamping parts abut against two opposite sides of the load board, respectively. In this way, the light-emitting diode on the load board is fixed on the mounting base together with the wire, the switch, and the circuit board.

In a second embodiment, an LED illumination apparatus applying the LED illumination apparatus module is disclosed. In addition to the foregoing LED illumination apparatus module, the LED illumination apparatus further includes a lamp shade accommodating the LED illumination apparatus module. The lamp shade includes a shade body and an alignment structure. The alignment structure is disposed on an internal surface of the shade body. The LED illumination apparatus module is assembled in the lamp shade and abuts against the alignment structure, so as to be located at a locked position.

In some embodiments, the alignment structure is two slots that are symmetrically disposed with respect to a central axis of the lamp shade. Two sides of the body portion of the frame has two side plate sets, and the two side plate sets are slidably disposed in the two slots, respectively. Each side plate set includes a front end section and a rear end section, the front end section is disposed on one end of the side plate set close to the LED assembly portion, and a spacing is between the front end section and the rear end section.

In some embodiments, the alignment structure is two stoppers that abut two opposite surfaces of the side plate set respectively, to hold the frame in a horizontal plane.

In this way, based on the configuration of the alignment structure of the lamp shade, the mounting base and the light-emitting diode, the wire, the circuit board, and the switch mounted on the mounting base may be located at the locked position together when the mounting base is assembled into the lamp shade, so that the assembly of the LED illumination apparatus is more convenient and an overall structure of the LED illumination apparatus may be more stable. Moreover, based on the design of configuring the alignment structure as two slots or two stoppers, time required for alignment may be reduced. When the mounting base is located in the lamp shade, a thread hole at the opening of the lamp shade and a thread hole at the bottom of the lamp shade also match with the thread holes of the LED illumination apparatus module, so that screws may be directly locked to the thread holes without alignment.

In some embodiments, the LED illumination apparatus further includes a snake-shaped pipe and an illumination apparatus base. The snake-shaped pipe includes two opposite ends, and one of the two ends of the snake-shaped pipe is fixedly connected to the lamp shade. The illumination apparatus base is fixedly connected to an end of the snake-shaped pipe which is away from the lamp shade.

In the following embodiments, specific features and advantages of the instant disclosure are described in detail. The content is sufficient to allow any person skilled in the art to understand the technical content of the instant disclosure and implement the technical content. In addition, any person skilled in the art can easily understand related objectives and advantages of the instant disclosure according to the content disclosed in this specification, claims, and drawings.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
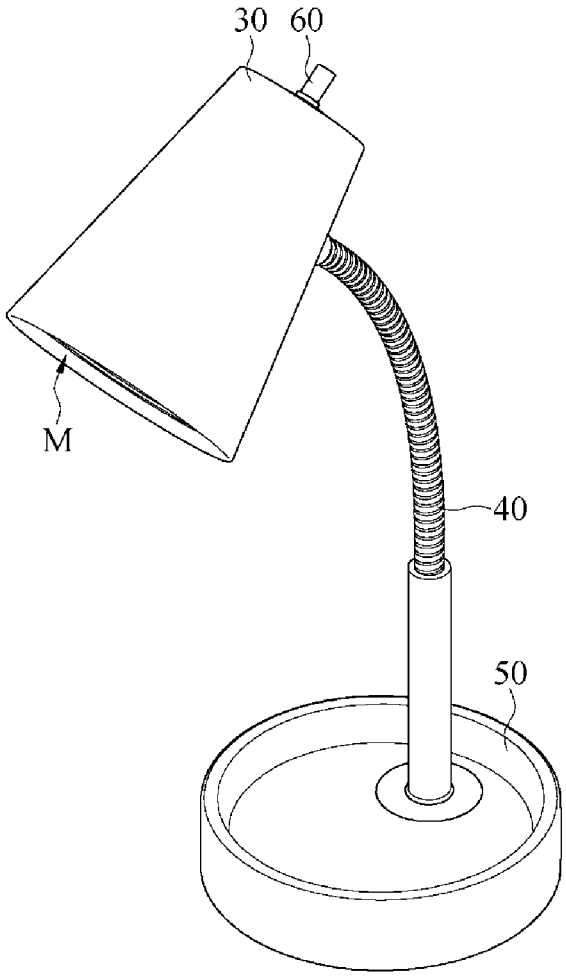
FIG. 1 is a schematic perspective view of an LED illumination apparatus according to a first embodiment of the instant disclosure.

The following is a detailed description of various embodiments. However, these embodiments are merely used as examples and are not intended to limit the scope of the instant disclosure. Well-known components are not described in the embodiments to avoid unnecessarily limiting the instant disclosure. In addition, drawings in the embodiments omit some components, to clearly show technical features of the instant disclosure. Identical reference numerals in all the drawings are used to represent identical or similar components.

In this specification, the terms "a" and "the" generally refer to one or more unless the article is specially limited in this specification. Furthermore, the terms "include", "comprise", "has" and similar words are used to indicate features, regions, integers, steps, operations, elements and/or components recorded therein, but do not exclude described or extra one or more other features, regions, integers, steps, operations, elements, components, and/or groups thereof.

First Embodiment

Figure 2:
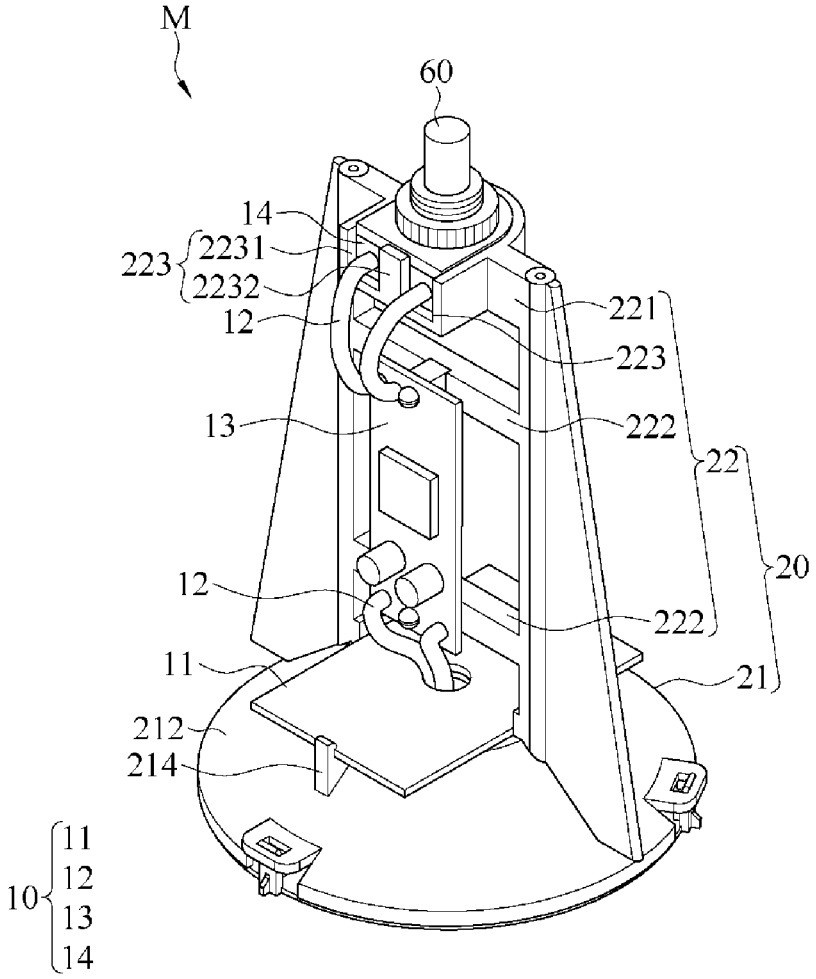
FIG. 2 is a perspective view of an LED illumination apparatus module according to a first embodiment of the instant disclosure.
Figure 3:
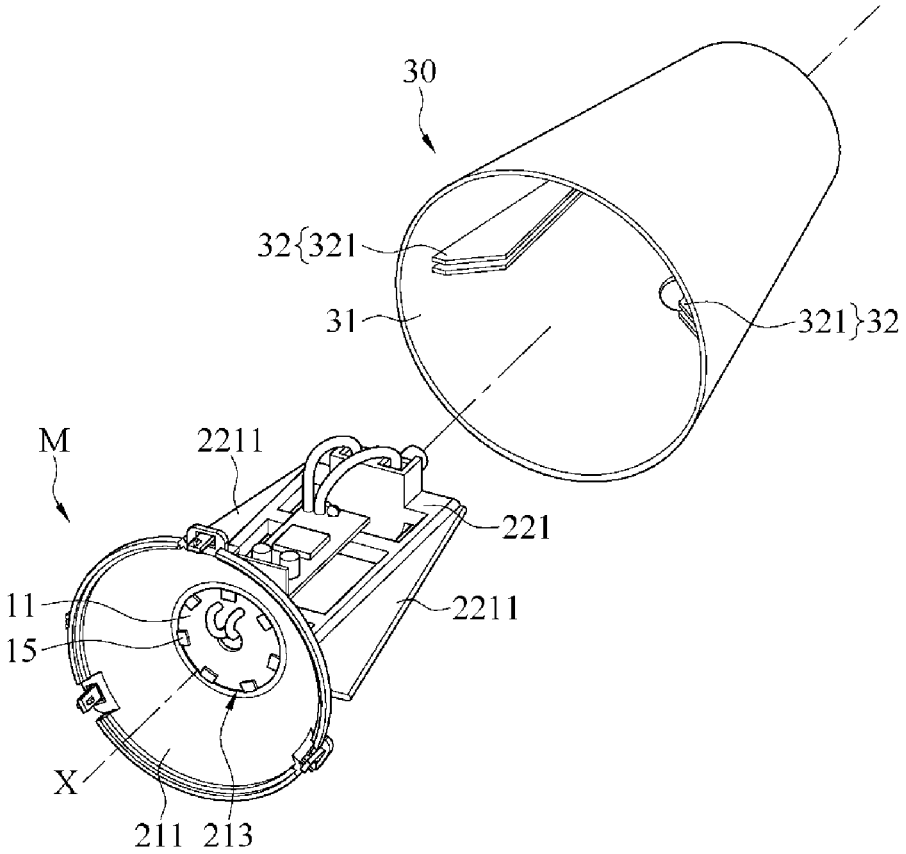
FIG. 3 is a partial exploded view of some components of an LED illumination apparatus according to a first embodiment of the instant disclosure.

Referring to FIG. 1 to FIG. 3, FIG. 1 is a schematic perspective view of an LED illumination apparatus according to the first embodiment of the instant disclosure, FIG. 2 is a perspective view of an LED illumination apparatus module according to the first embodiment of the instant disclosure, and FIG. 3 is a partial exploded view of some components of the LED illumination apparatus according to the first embodiment of the instant disclosure. It can be seen from FIG. 1 and FIG. 2 that, the LED illumination apparatus of this embodiment includes an LED illumination apparatus module M and a lamp shade 30. The LED illumination apparatus module M includes a light-emitting component 10 and a mounting base 20. It can be seen from FIG. 3 that, the LED illumination apparatus module M may be assembled into the lamp shade 30. The detailed structure of the LED illumination apparatus module M is described below.

It can be seen from FIG. 1 to FIG. 3, the light-emitting component 10 includes a load board 11, a wire 12, a circuit board 13, and at least one light-emitting diode 15. The at least one light-emitting diode 15 is disposed on a surface of the load board 11, and the wire 12 is electrically connected to the at least one light-emitting diode 15 and the circuit board 13. The number of the light-emitting diode 15 may be adjusted according to a required quantity, and in this embodiment, seven light-emitting diodes 15 are used. However, the instant disclosure is not limited thereto.

The mounting base 20 includes an LED assembly portion 21 and a frame 22. In this embodiment, the mounting base 20 may be an integral structure which can be obtained by compression molding, injection molding, or the like. However, the instant disclosure is not limited thereto, and the method may be changed according to designer requirements. For example, the mounting base 20 may alternatively be formed by assembling independent individual components (such as the LED assembly portion 21 and the frame 22) with each other. The LED assembly portion 21 and the frame 22 are described in detail below, and the connection relationship of the LED assembly portion 21, the frame 22, and the light-emitting component 10 is further described.

Refer to FIG. 2 to FIG. 3 again. Specifically, in this embodiment, the LED assembly portion 21 includes a reflecting surface 211, a mounting surface 212, and an opening 213. The reflecting surface 211 and the mounting surface 212 are located on two opposite sides. The opening 213 is defined through the reflecting surface 211 and the mounting surface 212. The load board 11 is fixed on the mounting surface 212 and corresponds to the opening 213, so that the at least one light-emitting diode 15 passes through the opening 213 and faces towards the reflecting surface 211. In this embodiment, two clamping parts 214 disposed on the mounting surface 212 (in FIG. 2, one clamping part 214 on one side of the mounting surface 212 is illustrated, and the other clamping part 214 disposed on the opposite side of the mounting surface 212 is omitted) are respectively abutted against two opposite sides of the load board 11, so that the load board 11 is fixed on the mounting surface 212. The shape of the load board 11 is not limited herein as long as the load board 11 can be clamped by the clamping parts 214 and be mounted on the mounting surface 212. In addition, since the foregoing reflecting surface 211 is concave inward to form a disk shape, after light rays of the light-emitting diode 15 pass through the opening 213, the light rays are emitted towards approximately the same direction through reflection of the reflecting surface 211.

Refer to FIG. 2 again. Then, one end of the frame 22 is connected to the mounting surface 212 of the LED assembly portion 21, that is, the end is located on the same side of the LED assembly portion 21 together with the load board 11. The frame 22 includes a body portion 221 and a circuit board fixing structure 222, and the circuit board fixing structure 222 is disposed on the body portion 221. In this embodiment, the body portion 221 is a rectangular support, and the circuit board 13 is fixed to the circuit board fixing structure 222. Optionally, a plurality of electronic components or control components may be disposed on the circuit board 13. However, the instant disclosure is not limited thereto. Alternatively, the electronic components or control components may be disposed on the load board 11.

In this way, by applying the foregoing configuration of the mounting base 20, the light-emitting diode 15, the wire 12, and the circuit board 13 may be modularized and fixed on the mounting base 20, so that it is easier to assemble the LED illumination apparatus module M into the lamp shade 30.

Figure 4:
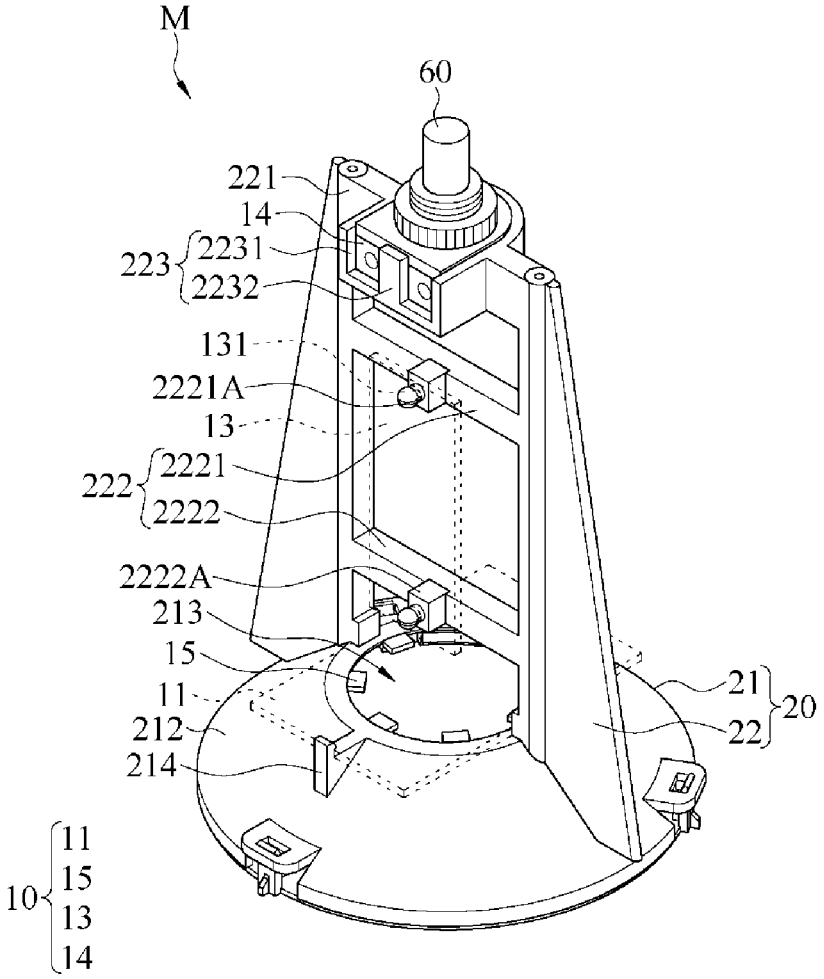
FIG. 4 is a partial perspective view of an LED illumination apparatus module according to a first embodiment of the instant disclosure.

Referring to FIG. 4, FIG. 4 is a partial perspective view of the LED illumination apparatus module according to the first embodiment of the instant disclosure. In this embodiment, the circuit board fixing structure 222 is an upper support 2221 and a lower support 2222 that are disposed parallel to each other, and two ends of the circuit board 13 are fixed to the upper support 2221 and the lower support 2222, respectively. By using the upper support 2221 and the lower support 2222 to assemble with the circuit board 13, the overall size of the mounting base 20 may be greatly reduced, to make the mounting base lighter and to reduce the material used in the mounting base. In addition, by the configuration of the upper support 2221 and the lower support 2222, different parts of the circuit board 13 and the electronic components disposed on the circuit board 13 can be supported by the upper support 2221 and the lower support 2222, so that more electronic components may be disposed on the circuit board 13 or a circuit board 13 with a larger area may be mounted, to further diversify light effects of the LED illumination apparatus.

Referring to FIG. 4 again, specifically, in this embodiment, the foregoing upper support 2221 includes a first protrusion portion 2221A, the lower support 2222 includes a second protrusion portion 2222A, and the first protrusion portion 2221A and the second protrusion portion 2222A extend out towards the same direction. When the circuit board 13 is assembled to the circuit board fixing structure 222, the first protrusion portion 2221A and the second protrusion portion 2222A pass through two assembly holes 131 in two ends of the circuit board 13, so that the two ends of the circuit board 13 are fixed to the upper support 2221 and the lower support 2222, respectively.

Figure 5:
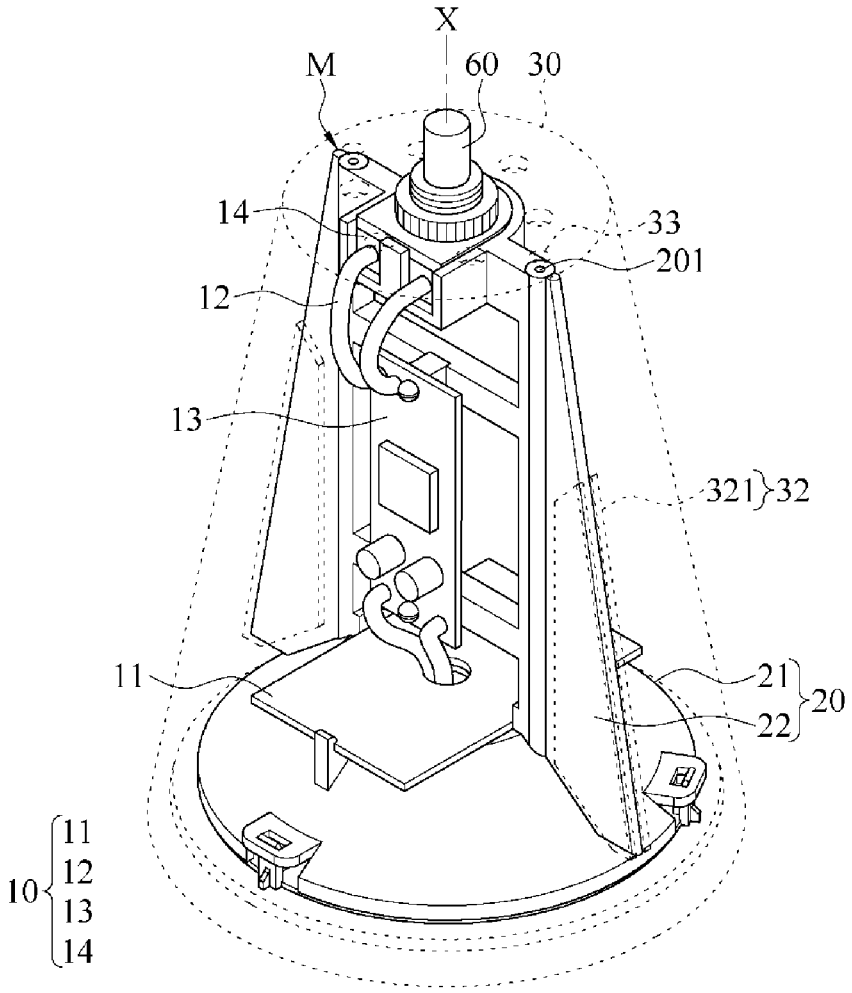
FIG. 5 is a schematic perspective view of an LED illumination apparatus module according to a first embodiment of the instant disclosure.

Referring to FIG. 2 to FIG. 3 again, in this embodiment, the light-emitting component 10 further includes a switch 14. The switch 14 is electrically connected to the light-emitting diode 15 and the circuit board 13 through the wire 12, to control the light-emitting diode 15 to emit light or not to emit light, or adjust luminance of light rays emitted by the light-emitting diode 15. Referring to FIG. 5, FIG. 5 is a schematic perspective view of an LED illumination apparatus module according to the first embodiment of the instant disclosure. Furthermore, a knob 60 is disposed on the switch 14, and a user uses the knob 60 to control the switch 14. The knob 60 may be replaced with another element, for example, a button. In this embodiment, the switch 14 is disposed close to the bottom of the lamp shade 30, the LED assembly portion 21 is disposed close to the opening of the lamp shade 30, and the bottom and the opening of the lamp shade 30 are disposed on two opposite ends of the lamp shade 30.

Referring to FIG. 2, FIG. 4, and FIG. 5 together, FIG. 5 is a schematic perspective view of an LED illumination apparatus module according to the first embodiment of the instant disclosure. In addition to the circuit board fixing structure 222, the frame 22 further includes a switch fixing structure 223. The switch fixing structure 223 is disposed at an end of the body portion 221 which is away from the LED assembly portion 21. The circuit board fixing structure 222 is located between the switch fixing structure 223 and the LED assembly portion 21. That is, when the LED illumination apparatus module M is assembled in the lamp shade 30, from the bottom to the opening of the lamp shade 30, the switch fixing structure 223, the circuit board fixing structure 222, and the LED assembly portion 21 are successively arranged. By assembling the switch 14 to the switch fixing structure 223, the switch 14 and the foregoing light-emitting diode 15 may be disposed at two ends of the mounting base 20 in the long side direction of the mounting base 20. When the mounting base 20 is assembled to the internal side of the lamp shade 30, the switch 14 may be disposed on the bottom of the lamp shade 30 at the same time, and the light-emitting component 10 may be disposed at an end of the mounting base 20 close to the opening of the lamp shade 30.

Referring to FIG. 2 to FIG. 4, specifically, in this embodiment, the switch fixing structure 223 includes a load slot 2231 in which the shape of the load slot 2231 corresponds to the shape of the switch 14. Therefore, the switch 14 may be closely fitted in the load slot 2231. In this embodiment, the shape of the load slot 2231 matches the shape of the switch 14, so that the switch 14 may be disposed in the load slot 2231 stably. Furthermore, in this embodiment, the load slot 2231 is a horseshoe-shaped slot, and the horseshoe-shape slot is further divided into a semicircular wall and an opening opposite to the semicircular wall. An arm-shaped protrusion 2232 is provided on a portion of the bottom of the load slot 2231 at the opening, to further divide the opening into two notches that allow the wire 12 connected to the switch 14 to pass through. The wire 12 is connected to the circuit board 13 after passing through the load slot 2231. However, the instant disclosure is not limited thereto, and the configuration of the load slot 2231 may be changed according to actual requirements.

Referring to FIG. 3 again, after the foregoing LED illumination apparatus module M is assembled, the LED illumination apparatus module M may be assembled into the lamp shade 30. The lamp shade 30 includes a shade body 31 and an alignment structure 32. The alignment structure 32 is disposed on an internal surface of the shade body 31. The LED illumination apparatus module M is assembled in the lamp shade 30 and abuts against the alignment structure 32, so as to be located at a locked position. The use of the alignment structure 32 can facilitate the assembly of the LED illumination apparatus module M and also prevent the relative rotation of the LED illumination apparatus module M around the central axis X during assembly, thereby increasing overall stability of the LED illumination apparatus.

Referring to FIG. 3 and FIG. 5 again, specifically, in this embodiment, the alignment structure 32 of the lamp shade 30 is two slots 321 that are symmetrically disposed with respect to the central axis X of the lamp shade 30, and two side plate sets 2211 on the two sides of the foregoing frame 22 are slidably disposed in the two slots 321, respectively. In detail, in this embodiment, the frame 22 includes two side plate sets 2211 disposed on two sides of the body portion 221, where each side plate set 2211 of the two side plate groups 2211 extends between two ends of the body portion 221 in the long side direction of the body portion 221. When the two side plate sets 2211 slide into the two slots 321, the LED illumination apparatus module M is located at the locked position. When the LED illumination apparatus module M is located at the locked position, the knob 60 connected to the switch 14 may pass through a hole in the bottom of the lamp shade 30, and a lockhole 201 in the bottom of the mounting base 20 is opposite to a thread hole 33 in the bottom of the lamp shade 30. Therefore, a screw element may directly pass through the thread hole 33 and the lockhole 201 without alignment, to fixedly combine the mounting base 20 with the lamp shade 30.

Figure 9:
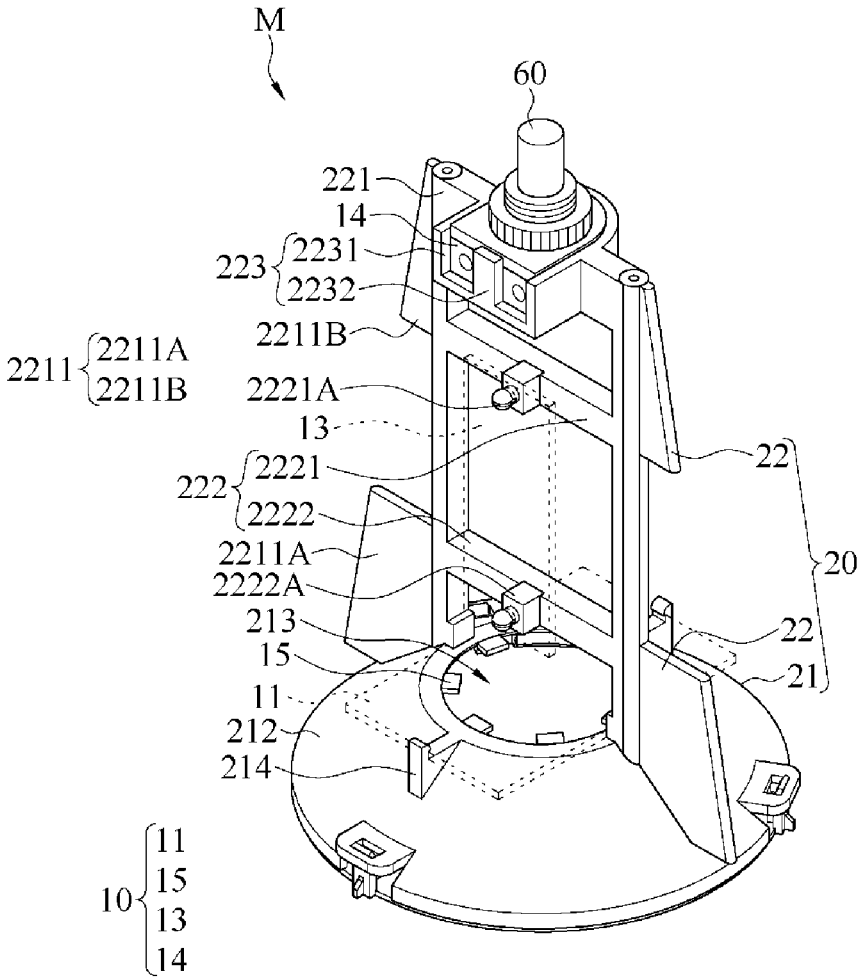
FIG. 9 is a perspective view of another implementation of an LED illumination apparatus module according to a first embodiment of the instant disclosure.

Referring to FIG. 9, FIG. 9 is a perspective view of another implementation of the LED illumination apparatus module according to the first embodiment of the instant disclosure. In some embodiments, each side plate set 2211 includes a front end section 2211A and a rear end section 2211B, the front end section 2211A is disposed at one end of the side plate set 2211 close to the LED assembly portion 21, and a a spacing is between the front end section 2211A and the rear end section 2211B. In other words, in this embodiment, the side plate set 2211 may include just one side plate, or may include two side plates that are not connected, such as the front end section 2211A and the rear end section 2211B.

It should be noted that the screw element may be a screw, a bolt, or another fixing elements. In addition, the shape of the two side plate sets 2211 matches the shape of the lamp shade 30, that is, side edges of the side plate sets 2211 may be in contact with the internal surface of the lamp shade 30.

Figure 6:
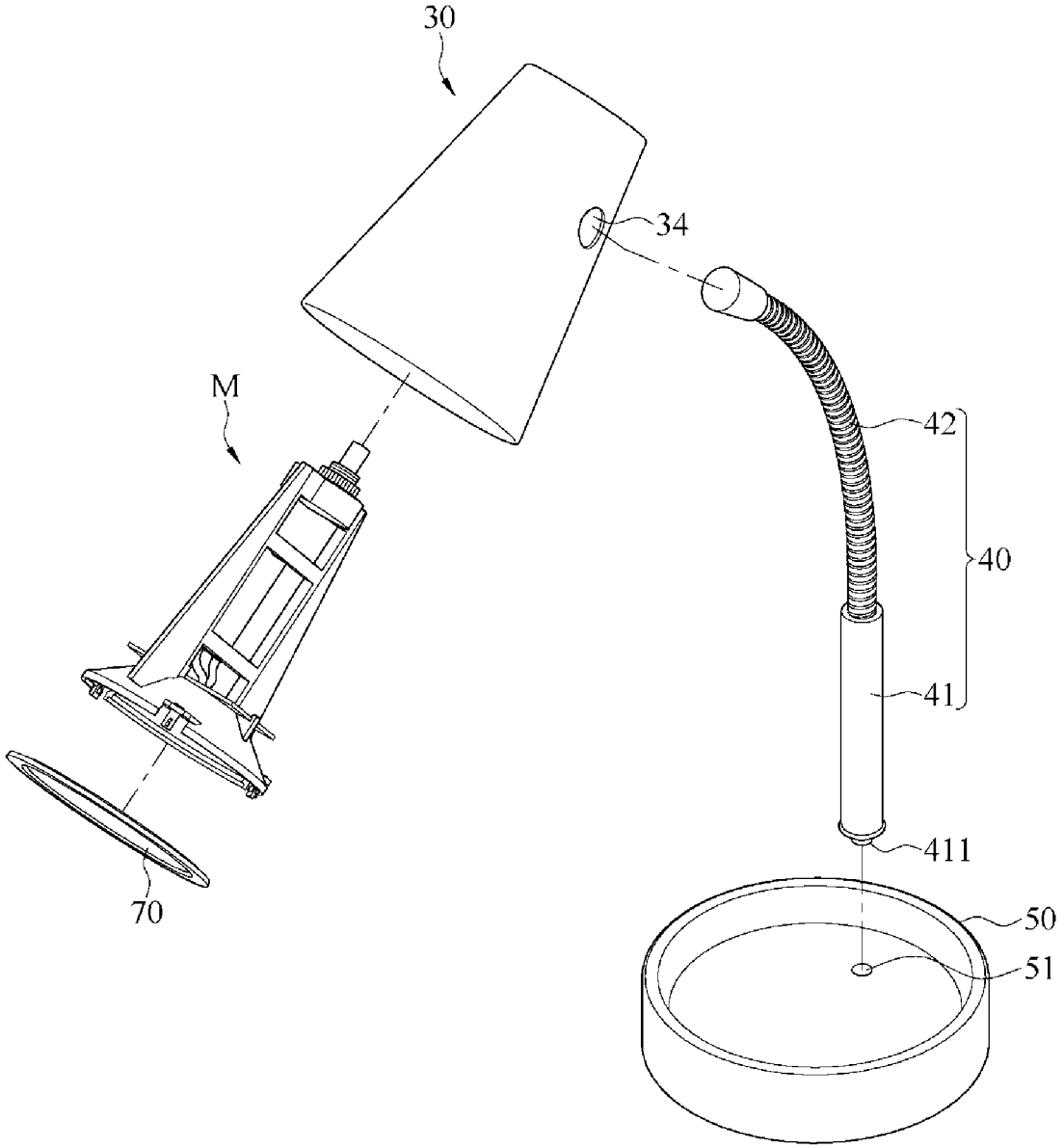
FIG. 6 is a partial exploded view of an LED illumination apparatus according to a first embodiment of the instant disclosure.

Referring to FIG. 6, FIG. 6 is a partial exploded view of the LED illumination apparatus according to the first embodiment of the instant disclosure. In this embodiment, the LED illumination apparatus further includes a snake-shaped pipe 40 and an illumination apparatus base 50. The lamp shade 30 is assembled to the snake-shaped pipe 40, and the snake-shaped pipe 40 is disposed on the illumination apparatus base 50. The snake-shaped pipe 40 includes two opposite ends, one of two ends of the snake-shaped pipe 40 is fixedly connected to the lamp shade 30 and the other end is fixedly connected to the illumination apparatus base 50. Specifically, in this embodiment, the lamp shade 30 includes a mounting hole 34, and one end of the snake-shaped pipe 40 passes through the mounting hole 34, so that the lamp shade 30 and the LED illumination apparatus module M are fixed to one end of the snake-shaped pipe 40. The illumination apparatus base 50 includes a fixing hole 51, and the other end of the snake-shaped pipe 40 passes through the fixing hole 51 to be assembled to the illumination apparatus base 50.

Refer to FIG. 6 again. More specifically, in this embodiment, the snake-shaped pipe 40 includes a bushing 41 and a hose 42. The hose 42 is sleeved in the bushing 41 and is connected to the lamp shade 30. One end of the bushing 41 which is connected to the illumination apparatus base 50 includes a fixing bulge 411. The shape of the fixing bulge 411 matches the fixing hole 51, so that the bushing 41 may be clamped on the illumination apparatus base 50. The fixing bulge 411 may be replaced with other fixing elements. For example, the fixing bulge 411 is replaced with a screw with male threads, and the fixing hole 51 may be a notch with female threads, so that the bushing 41 is fixed in the fixing hole 50 by threading with each other.

In addition, in this embodiment, the shape of the illumination apparatus base 50 may be selected according to actual demand, for example, a disk shape or a plate shape that can be placed on a desk, or a clamping structure that can be clamped on side edges of a desk.

It can be seen from FIG. 6 that, in this embodiment, the LED illumination apparatus may further include a light diffuser 70. The light diffuser 70 covers the opening of the lamp shade 30, and in this embodiment, the light diffuser 70 is assembled to the LED illumination apparatus module M in a clamping manner. In another implementation, the light diffuser 70 may be clamped on the lamp shade 30, or may be locked together with the LED illumination apparatus module M or the lamp shade 30 by ways of screwing. In this way, the light-emitting diode 15 adjacent to the opening may be prevented from being damaged by collisions.

Second Embodiment

Figure 7:
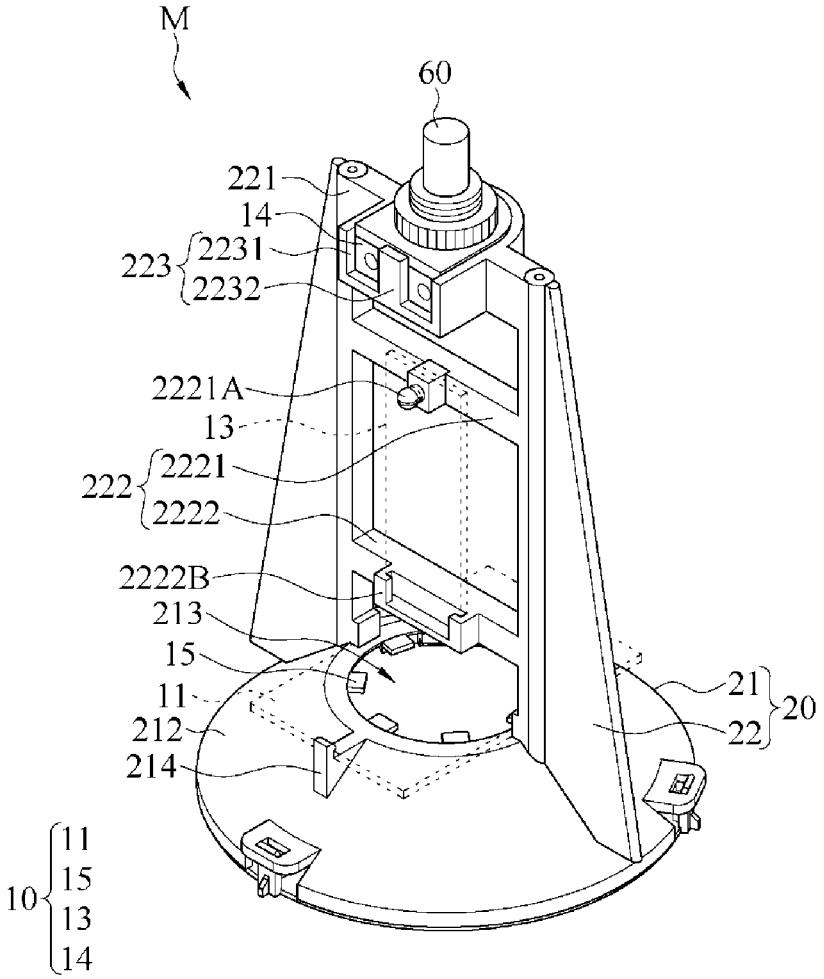
FIG. 7 is a partial perspective view of an LED illumination apparatus module according to a second embodiment of the instant disclosure.

Referring to FIG. 7, FIG. 7 is a partial perspective view of an LED illumination apparatus module according to the second embodiment of the instant disclosure. In this embodiment, components that are same as those in the first embodiment are marked with the same reference numerals, and same components and structures are not described repeatedly herein. In this embodiment, the upper support 2221 also includes the first protrusion portion 2221A, and in this embodiment, the second protrusion portion 2222A of the lower support 2222 in the first embodiment is replaced with a second containing slot 2222B. Specifically, in this embodiment, the second containing slot 2222B is a groove with a notch facing towards the first protrusion portion 2221A. When the circuit board 13 is assembled to the circuit board fixing structure 222, an end portion of the circuit board 13 is disposed in the second containing slot 2222B, and the first protrusion portion 2221A of the upper support 2221 passes through the assembly hole 131 located in one of the two end portions of the circuit board 13. In this way, the circuit board 13 can be stably fixed on the frame 22.

Third Embodiment

Figure 8:
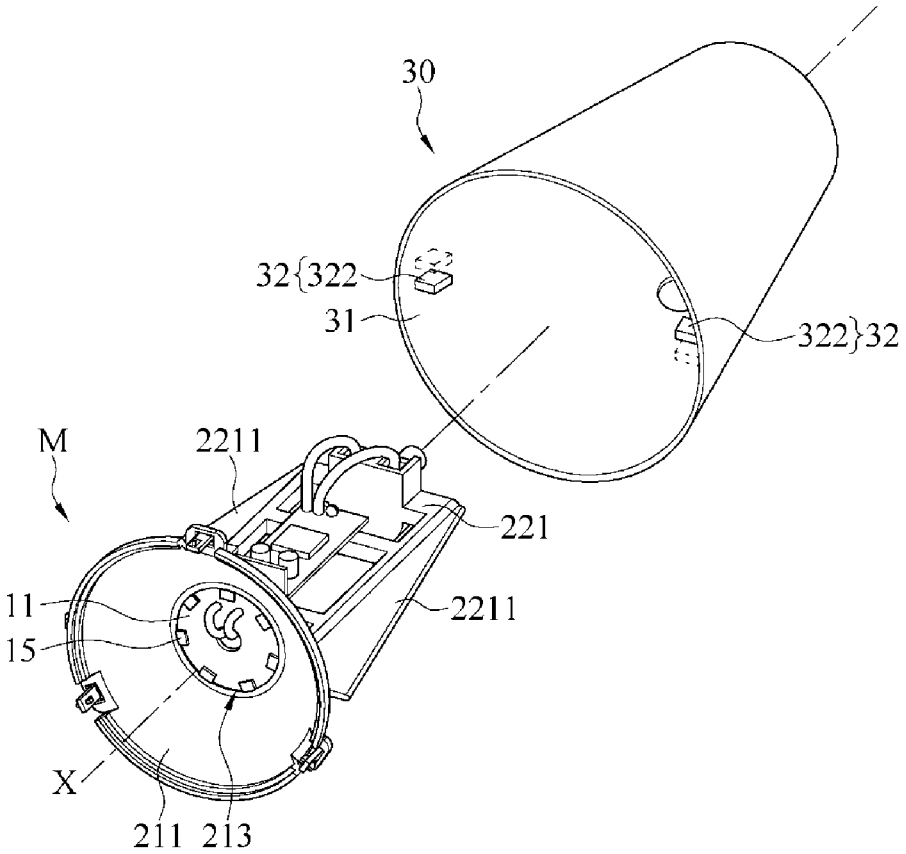
FIG. 8 is a partial exploded view of some components of an LED illumination apparatus according to a third embodiment of the instant disclosure.

Referring to FIG. 8, FIG. 8 is a partial-exploded view of some components of an LED illumination apparatus according to the third embodiment of the instant disclosure. In this embodiment, components that are same as those in the first embodiment are marked with the same reference numerals, and same components and structures are not described repeatedly herein. In this embodiment, the alignment structure 32 of the lamp shade 30 is two stoppers 322 disposed symmetrically with respect to the central axis X of the lamp shade 30, and the two stoppers 322 are in contact with two opposite surfaces of the side plate set 2211, respectively, to position the frame 22 in a horizontal plane. The two stoppers 322 respectively abut against the two opposite surfaces of the side plate set 2211, so that the mounting base 20 does not rotate clockwise or anticlockwise after being mounted in the lamp shade 30, thereby achieving a positioning effect. In the implementation, the alignment structure 32 is not limited to two stoppers 322; alternatively, the alignment structure 32 may be four stoppers 322, and two stoppers 322 abut against two opposite surfaces of each side plate set 2211 of the mounting base 20, respectively, so that each side plate set 2211 is clamped by two stoppers 322 and the LED illumination apparatus module M is located in the locked position. It should be noted that a possible implementation of the side plate set 2211 has been described in the first embodiment and is not repeated herein.

It should be noted that the circuit board fixing structure 222 of the frame 22 of the LED illumination apparatus and the alignment structure 32 of the lamp shade 30 of the instant disclosure may be combined randomly according to the foregoing implementations. That is, the LED illumination apparatus is not necessarily the combination of the frame 22 including the first protrusion portion 2221A and the second protrusion portion 2222A and the lamp shade 30 including the slots 321 as shown in the first embodiment, but may also be the combination of the frame 22 including the first protrusion portion 2221A and the second protrusion portion 2222A as shown in the first embodiment and the lamp shade 30 including two stoppers 322 as shown in the third embodiment. Similarly, the LED illumination apparatus is not necessarily the combination of the frame 22 including the first protrusion portion 2221A and the second containing slot 2222B as shown in the second embodiment and the lamp shade 30 including the stoppers 322 as shown in the third embodiment, but may also be the combination of the frame 22 including the first protrusion portion 2221A and the second containing slot 2222B as shown in the second embodiment and the lamp shade 30 including the slots 321 as shown in the first embodiment.

In conclusion, in the LED illumination apparatus module M disclosed in the instant disclosure, a plurality of light-emitting diodes 15, wires 12, and circuit boards 13 may be modularized and all assembled to the lamp shade 30 after being fixed on the mounting base 20, to improve assembly convenience. Since the light-emitting diode 15, the wire 12, and the circuit board 13 are fixed on the mounting base 20, these components can be prevented from being dragged or collided easily during assembling these components to the lamp shade 30, thereby increasing the assembly yield of LED illumination apparatuses. In addition, by using the upper support 2221 and the lower support 2222 to with assemble the circuit board 13, an overall size of the mounting base 20 may be greatly reduced, to make the mounting base lighter and to reduce the material used in the mounting base. Moreover, based on the configuration of the alignment structure 32 of the lamp shade 30, the mounting base 20 and the light-emitting diode 15, the wire 12, the circuit board 13, and the switch 14 mounted on the mounting base may be located at the locked position together when the mounting base 20 is assembled into the lamp shade 30, so that the assembly of the LED illumination apparatus is more convenient and an overall structure of the LED illumination apparatus may be more stable.

Although the instant disclosure has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An LED illumination apparatus module, comprising:

a light-emitting component, comprising a load board, a wire, a circuit board, and at least one light-emitting diode, wherein the at least one light-emitting diode is disposed on a surface of the load board, and the wire is electrically connected to the at least one light-emitting diode and the circuit board; and a mounting base, comprising:

an LED assembly portion, comprising a reflecting surface, a mounting surface, and an opening, wherein the reflecting surface and the mounting surface are located on two opposite sides, the opening is defined through the reflecting surface and the mounting surface, and the load board is fixed on the mounting surface and corresponds to the opening, so that the at least one light-emitting diode passes through the opening and faces towards the reflecting surface; and a frame, an end thereof being connected to the mounting surface of the LED assembly portion, the frame comprising a body portion and a circuit board fixing structure, wherein the circuit board fixing structure is disposed on the body portion, and the circuit board is fixed to the circuit board fixing structure.

2. The LED illumination apparatus module according to claim 1, wherein the frame further comprises a switch fixing structure, the light-emitting component further comprises a switch, the switch fixing structure is disposed at an end of the body portion which is away from the LED assembly portion, and the switch is assembled to the switch fixing structure.

3. The LED illumination apparatus module according to claim 2, wherein the switch fixing structure comprises a load slot, and the shape of the load slot corresponds to the shape of the switch, so that the switch is closely fitted the load slot.

4. The LED illumination apparatus module according to claim 2, wherein the circuit board fixing structure is located between the switch fixing structure and the LED assembly portion.

5. The LED illumination apparatus module according to claim 4, wherein the circuit board fixing structure comprises an upper support and a lower support disposed parallel to each other, and two ends of the circuit board are fixed to the upper support and the lower support, respectively.

6. The LED illumination apparatus module according to claim 5, wherein the upper support comprises a first protrusion portion, the lower support comprises a second protrusion portion, the first protrusion portion and the second protrusion portion extend towards the same direction, the circuit board comprises two assembly holes provided in two end portions, respectively, and when the circuit board is assembled to the circuit board fixing structure, the first protrusion portion and the second protrusion portion pass through the corresponding assembly holes, respectively.

7. The LED illumination apparatus module according to claim 5, wherein the upper support comprises a first protrusion portion, the lower support comprises a second containing slot, a notch of the second containing slot is disposed towards the first protrusion portion, the circuit board comprises an assembly hole disposed at one of two end portions of the circuit board, and when the circuit board is assembled to the circuit board fixing structure, the other end portion of the circuit board is disposed in the second containing slot, to make the first protrusion portion of the upper support pass through the assembly hole.

8. The LED illumination apparatus module according to claim 1, wherein the LED assembly portion further comprises two clamping parts, the two clamping parts are disposed on the mounting surface, and the two clamping parts abut against two opposite sides of the load board, respectively.

9. An LED illumination apparatus, comprising:

an LED illumination apparatus module, comprising:

a light-emitting component, comprising a load board, a wire, a circuit board, and at least one light-emitting diode, wherein the at least one light-emitting diode is disposed on a surface of the load board, and the wire is electrically connected to the at least one light-emitting diode and the circuit board; and a mounting base, comprising:

an LED assembly portion, wherein the LED assembly portion comprises a reflecting surface, a mounting surface, and an opening, the reflecting surface and the mounting surface are located on two opposite sides, the opening is defined through the reflecting surface and the mounting surface, and the load board is fixed on the mounting surface and corresponds to the opening, so that the at least one light-emitting diode passes through the opening and faces towards the reflecting surface; and a frame, an end thereof being connected to the mounting surface of the LED assembly portion, the frame comprising a body portion and a circuit board fixing structure, wherein the circuit board fixing structure is disposed on the body portion, and the circuit board is fixed to the circuit board fixing structure; and a lamp shade, comprising a shade body and an alignment structure, wherein the alignment structure is disposed on an internal surface of the shade body, and the LED illumination apparatus module is assembled in the lamp shade and abuts against the alignment structure, so as to be located at a locked position.

10. The LED illumination apparatus according to claim 9, wherein the frame further comprises two side plate sets disposed on two sides of the body portion, and each side plate set extends between two ends of the body portion in a long side direction.

11. The LED illumination apparatus according to claim 10, wherein each side plate set comprises a front end section and a rear end section, the front end section is disposed on one end of the side plate set close to the LED assembly portion and a spacing is between the front end section and the rear end section.

12. The LED illumination apparatus according to claim 10, wherein the alignment structure of the lamp shade is two slots, the two slots are symmetrically disposed with respect to a central axis of the lamp shade, and the two side plate groups are slidably disposed in the two slots, respectively.

13. The LED illumination apparatus according to claim 10, wherein the alignment structure is two stoppers that abut two opposite sides of the side plate set respectively, to hold position? the frame in a horizontal plane.

14. The LED illumination apparatus according to claim 9, wherein the frame further comprises a switch fixing structure, the light-emitting component further comprises a switch, the switch fixing structure is disposed at an end of the body portion which is away from the LED assembly portion, and the switch is assembled to the switch fixing structure.

15. The LED illumination apparatus according to claim 14, wherein the switch fixing structure comprises a load slot, and the shape of the load slot corresponds to the shape of the switch, so that the switch is closely fitted in the load slot.

16. The LED illumination apparatus according to claim 9, wherein the circuit board fixing structure is located between the switch fixing structure and the LED assembly portion, the circuit board fixing structure comprises an upper support and a lower support disposed parallel to each other, and two ends of the circuit board are fixed to the upper support and the lower support, respectively.

17. The LED illumination apparatus according to claim 16, wherein the upper support comprises a first protrusion portion, the lower support comprises a second protrusion portion, the first protrusion portion and the second protrusion portion extend in the same direction, the circuit board comprises two assembly holes provided in two end portions, respectively, and when the circuit board is assembled to the circuit board fixing structure, the first protrusion portion and the second protrusion portion pass through the corresponding assembly holes, respectively.

18. The LED illumination apparatus according to claim 16, wherein the upper support comprises a first protrusion portion, the lower support comprises a second containing slot, a notch of the second containing slot is disposed towards the first protrusion portion, the circuit board comprises an assembly hole disposed at one of two end portions of the circuit board, and when the circuit board is assembled to the circuit board fixing structure, the other end portion of the circuit board is disposed in the second containing slot, to make the first protrusion portion of the upper support pass through the assembly hole.

19. The LED illumination apparatus according to claim 9, wherein the assembly portion further comprises two clamping parts, the two clamping parts are disposed on the mounting surface, and the two clamping parts abut against two opposite sides of the load board, respectively.

20. The LED illumination apparatus according to claim 9, further comprising a snake-shaped pipe and an illumination apparatus base, the snake-shaped pipe comprises two opposite ends, one of two ends of the snake-shaped pipe is fixedly connected to the lamp shade, and the other end is fixedly connected to the illumination apparatus base.

* * * * *